US009409044B2

(12) United States Patent
Murray et al.

(10) Patent No.: US 9,409,044 B2
(45) Date of Patent: Aug. 9, 2016

(54) MODULAR TURNOUT GEAR

(71) Applicant: Globe Holding Company LLC, Pittsfield, NH (US)

(72) Inventors: Kevin Murray, Portland, OR (US); Mark Mordecai, Hampton, NH (US)

(73) Assignee: Globe Holding Company LLC, Pittsfield, NH (US)

( * ) Notice: Subject to any disclaimer, the term of this patent is extended or adjusted under 35 U.S.C. 154(b) by 0 days.

(21) Appl. No.: 14/454,461

(22) Filed: Aug. 7, 2014

(65) Prior Publication Data

US 2015/0040300 A1 Feb. 12, 2015

Related U.S. Application Data

(60) Provisional application No. 61/863,305, filed on Aug. 7, 2013.

(51) Int. Cl.

| | |
|---|---|
| ***A62B 17/00*** | (2006.01) |
| ***A41D 1/04*** | (2006.01) |
| ***A41D 3/02*** | (2006.01) |
| ***A41D 1/02*** | (2006.01) |
| *A41D 27/00* | (2006.01) |

(52) U.S. Cl.

CPC ..... *A62B 17/003* (2013.01); *A62B 17/00* (2013.01)

(58) Field of Classification Search

CPC . A41D 13/0007; A41D 13/002; A41D 27/04; A41D 13/01; A41D 2400/22; A41D 31/0027; A41D 31/02; A41D 3/00; A41D 3/04; A41D 1/067; A41D 2200/20; A41D 27/02; A41D 31/0022; A41D 31/0033; A41D 31/0083; A62B 17/003; A62B 35/0025; A62B 35/0037; A62B 17/006; A62B 17/00; A62B 25/00; A62B 7/02

See application file for complete search history.

(56) References Cited

U.S. PATENT DOCUMENTS

| | | | | |
|---|---|---|---|---|
| 4,320,538 | A * | 3/1982 | Saft | 2/102 |
| 4,782,534 | A | 11/1988 | Grilliot et al. | |
| 4,999,850 | A | 3/1991 | Grilliot et al. | |
| 5,095,549 | A | 3/1992 | Aldridge | |
| 5,131,097 | A | 7/1992 | Grilliot | |
| 5,746,442 | A | 5/1998 | Hoyaukin | |
| 5,953,750 | A | 9/1999 | Stella | |
| 6,336,221 | B1 * | 1/2002 | Blauer et al. | 2/87 |
| 6,336,223 | B1 | 1/2002 | Snedeker | |
| 6,490,734 | B2 * | 12/2002 | Blauer et al. | 2/87 |
| 6,745,405 | B2 * | 6/2004 | Blauer et al. | 2/456 |

(Continued)

FOREIGN PATENT DOCUMENTS

WO 0139620 A1 6/2001

OTHER PUBLICATIONS

International Search Report and Written Opinion received in PCT Application No. PCT/US2014/50197, dated Dec. 1, 2014, 11 pages.

*Primary Examiner* — Bobby Muromoto, Jr.
(74) *Attorney, Agent, or Firm* — Finch & Maloney PLLC

(57) ABSTRACT

A modular garment includes a sleeved jacket and a vest that may be worn by a first responder. The sleeved jacket is constructed for use in some emergency circumstances, including technical rescue operations. Portions of the jacket, including at least portions of the sleeves, may be constructed to satisfy more stringent garment standards, such as garment standards for structural firefighting. A vest may be worn over the sleeved jacket to produce a combined jacket suitable for use as turnout gear in structural firefighting.

16 Claims, 5 Drawing Sheets

(56) References Cited

U.S. PATENT DOCUMENTS

| | | | | |
|---|---|---|---|---|
| 6,934,970 | B1 * | 8/2005 | Watkins et al. | 2/96 |
| 6,978,481 | B2 * | 12/2005 | Mordecai et al. | 2/81 |
| 6,990,687 | B2 * | 1/2006 | Snedeker et al. | 2/79 |
| 7,065,796 | B2 * | 6/2006 | Watkins et al. | 2/227 |
| 7,908,767 | B1 * | 3/2011 | Mordecai et al. | 36/1.5 |
| 7,921,471 | B2 * | 4/2011 | Mordecai et al. | 2/98 |
| 8,002,082 | B2 * | 8/2011 | Snedeker | 182/3 |
| 8,281,894 | B2 * | 10/2012 | Mordecai et al. | 182/3 |
| 8,443,937 | B2 * | 5/2013 | Mordecai et al. | 182/3 |
| 8,464,367 | B1 * | 6/2013 | Mordecai et al. | 2/458 |
| 2001/0034897 | A1 * | 11/2001 | Belcher | 2/458 |
| 2002/0059674 | A1 * | 5/2002 | Blauer et al. | 2/87 |
| 2003/0126675 | A1 * | 7/2003 | Blauer et al. | 2/456 |
| 2003/0203688 | A1 * | 10/2003 | Campbell et al. | 442/130 |
| 2004/0140152 | A1 * | 7/2004 | Richardson | 182/3 |
| 2005/0223462 | A1 * | 10/2005 | Snedeker et al. | 2/69 |
| 2005/0223463 | A1 * | 10/2005 | Mordecai et al. | 2/81 |
| 2005/0229292 | A1 * | 10/2005 | Watkins et al. | 2/227 |
| 2006/0019566 | A1 * | 1/2006 | Lloyd et al. | 442/136 |
| 2007/0017008 | A1 * | 1/2007 | Snedeker et al. | 2/456 |
| 2007/0169247 | A1 * | 7/2007 | Mordecai et al. | 2/81 |
| 2007/0204377 | A1 * | 9/2007 | Mordecai et al. | 2/69 |
| 2008/0005825 | A1 | 1/2008 | Tronvold | |
| 2008/0107886 | A1 * | 5/2008 | Lloyd et al. | 428/221 |
| 2008/0164095 | A1 * | 7/2008 | Snedeker | 182/3 |
| 2008/0256680 | A1 | 10/2008 | Peksoz et al. | |
| 2009/0078501 | A1 * | 3/2009 | Mordecai et al. | 182/6 |
| 2010/0186136 | A1 | 7/2010 | Blauer et al. | |
| 2011/0107621 | A1 * | 5/2011 | Mordecai et al. | 36/113 |
| 2011/0131694 | A1 | 6/2011 | Fearon | |
| 2011/0179607 | A1 * | 7/2011 | Colorado | 24/573.11 |
| 2011/0197891 | A1 * | 8/2011 | Sanders | 128/205.22 |
| 2012/0260396 | A1 * | 10/2012 | Mordecai | 2/97 |
| 2013/0036537 | A1 | 2/2013 | Reynolds et al. | |
| 2014/0352023 | A1 * | 12/2014 | Mordecai et al. | 2/69 |
| 2015/0040300 | A1 * | 2/2015 | Murray et al. | 2/455 |

* cited by examiner 100
102
104
106
108
110
112
116
118
120
122
BACK
FRONT 200
212
206
210
214
208
204
202
216
BACK
FRONT

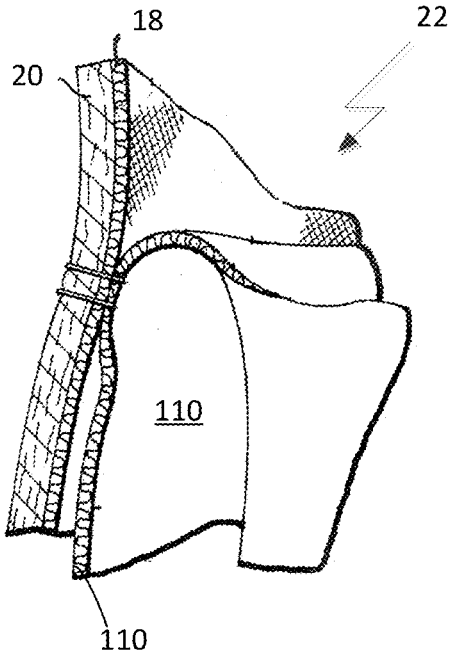
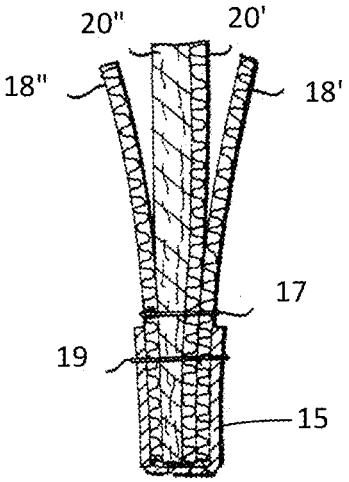
FIG. 5

MODULAR TURNOUT GEAR

PRIORITY

This application claims priority under 35 U.S. Code §119 to U.S. provisional application Ser. No. 61/863,305, filed on Aug. 7, 2013 and entitled "MODULAR TURNOUT GEAR, the contents of which are hereby incorporated by reference in their entirety.

FIELD OF THE INVENTION

Aspects of the invention relate to protective clothing and, in particular, to a jacket that is suitable for use in technical rescue incidents in a first configuration as well as being suitable for use in structural firefighting in a second configuration.

BACKGROUND

Firefighters and other first responders may engage in a wide variety of activities associated with different levels of risk. Frequently, responders are exposed to a variety of hazardous conditions such as flame, smoke, and high heat. Clothing used by such professionals may be designed to protect against one or more of these specific conditions in addition to being abrasion resistant, chemically resistant, and waterproof In efforts to minimize risk, organizations such as the National Fire Protection Association (NFPA) provide standards for the clothing that firefighters and other responders wear while performing various activities. By way of example, standard NFPA 1951 identifies design and performance criteria for garments that are to be used in technical rescue operations, including separate criterial for utility activities and rescue and recovery activities. Similarly, standard NFPA 1971 identifies design and performance criteria for garments that are to be used in structural firefighting, including separate criteria for structural firefighting, proximity firefighting, and Chemical, Biological, Radiological, and Nuclear (CBRN) activities. When structural firefighting, responders are engaged in firefighting within enclosed spaces with excessive heat and flashover risks. The European Union has also established standard EN 469 that defines criteria for clothing worn by firefighters and other responders.

SUMMARY

In one aspect, a firefighting ensemble includes both a jacket and a vest to be worn together. In many embodiments, the vest is worn over the jacket. The jacket includes sleeves and a torso portion. In some embodiments, the sleeves of the jacket exhibit a minimum Total Heat Loss of 205 W/m$^2$ while the torso portion exhibits a minimum Total Heat Loss of at least 450 W/m$^2$. The sleeves can exhibit a Thermal Protective Performance score of at least 35 while the torso portion of the jacket can exhibit a Thermal Protective Performance value of less than 35. In another embodiment, the torso portion of the jacket has a thermal protective score of at least 10 but not more than 35. The jacket may include a liner that has a moisture barrier and/or a thermal barrier layer, such portions located in the sleeves may be removable. The jacket also includes an outer flame-resistant layer, on the sleeve and/or the torso portion of the jacket.

The vest includes a torso portion, is interoperable with the jacket and in some embodiments is worn over the jacket. In combination with the torso portion of the jacket, the vest exhibits a Thermal Protective Performance score of at least 35, so that the ensemble of the vest worn with the jacket provides a Thermal Protective Performance score of at least 35 in both the arms and the torso portions. In some embodiments, the vest may include a drag rescue device. In some embodiments, the vest includes cuffs that attach to the torso portion of the vest and may create a thermal seal when placed over the jacket.

In some embodiments of the invention, the jacket when donned without the vest can meet the NFPA 1951 standards, and when worn in connection with the vest can meet the NFPA 1971 standards. In other embodiments, the vest and jacket together have a minimum Total Heat Loss of at least 205 W/m$^2$. In further embodiments, the vest and jacket together have a Thermal Protective Performance score of at least 35.

The subject matter of this application may involve, in some cases, interrelated products, alternative solutions to a particular problem, and/or a plurality of different uses of a single system or article.

The present invention is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention.

BRIEF DESCRIPTION OF THE DRAWINGS

In the drawings, different embodiments of the invention are illustrated in which:

FIG. 4 is a cross-sectional cutaway view of the outer layer, moisture barrier layer, and thermal layer of one embodiment;

FIG. 5 is a cross-sectional cutaway view of a thermal barrier and a moisture barrier within one embodiment of a jacket or vest.

DETAILED DESCRIPTION

Figures 1A, 1B:
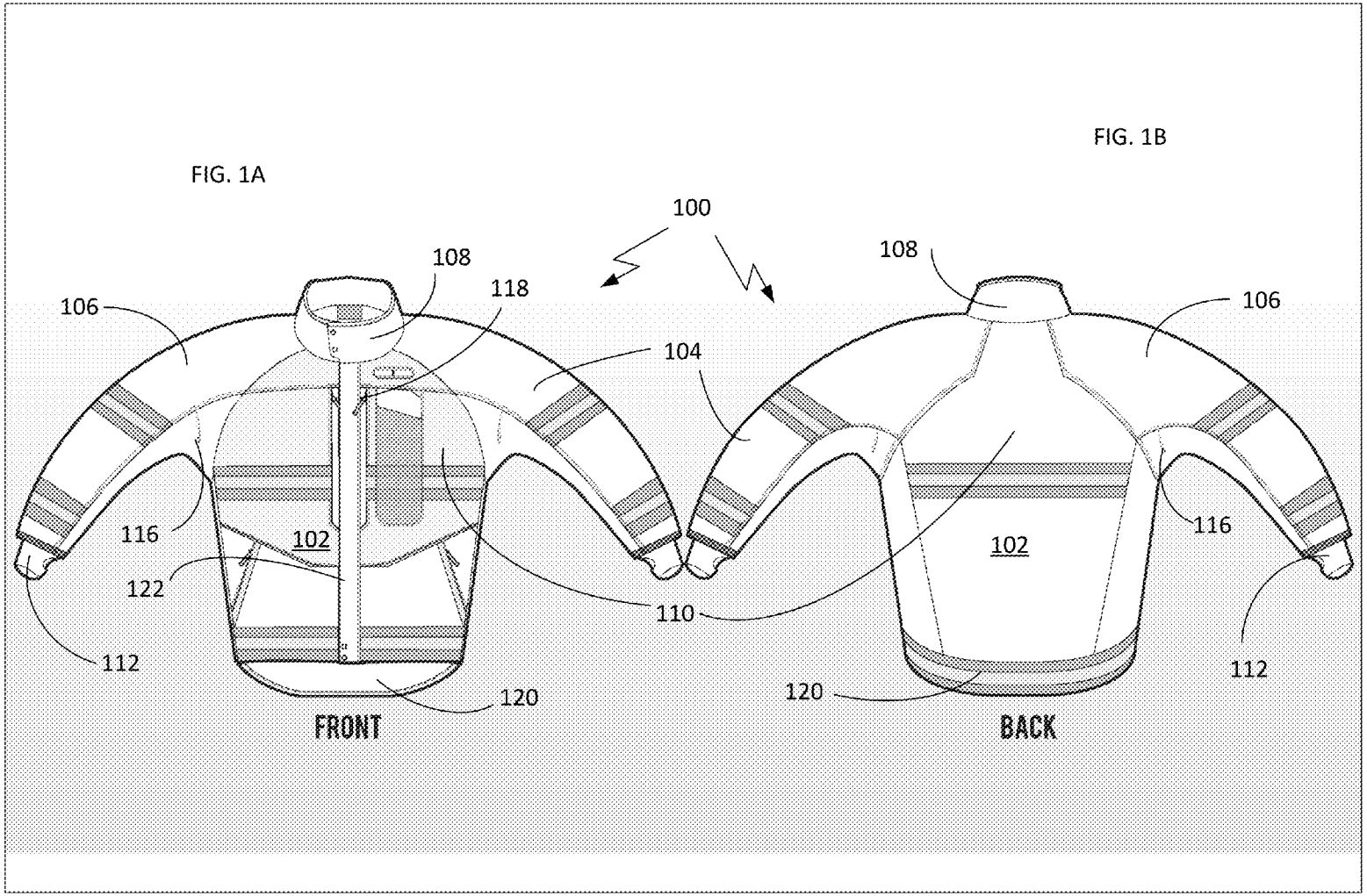
FIGS. 1A and 1B provide front and rear views of one embodiment of a jacket.

Described herein is modular garment that includes a sleeved jacket and a vest that may be used by a first responder. The sleeved jacket is constructed for use in some emergency circumstances, including technical rescue operations, and may satisfy some or all of aspects of associated garment standards (e.g., rescue and recovery aspects of NFPA 1951 and/or EN 469). Portions of the jacket, including at least portions of the sleeves, may be constructed to satisfy more stringent garment standards, such as those for structural firefighting. A vest that, taken alone, may not satisfy garment standards for structural firefighting may be worn in combination with the sleeved jacket to produce a combined jacket suitable for use in structural firefighting and that may satisfy associated garment standards (e.g., structural firefighting aspects of NFPA 1971 and/or EN 469).

Garments that are used in structural firefighting tend to be bulky and cumbersome and tend to retain body heat of the responder. Typically, such garment designs include an abrasion resistant outer shell, a moisture barrier, and a thermal barrier. Performance related aspects of structural firefighting garment standards (i.e., structural firefighting aspects of NFPA 1971 and/or EN 469) indicate a minimum Thermal Protective Performance (TPP) score of 35 and a moisture barrier layer minimum water penetration resistance of 25 pounds per square inch. Garments satisfying these criteria often retain body heat of the wearer, as is reflected in the 205 Watts per square meter minimum Total Heat Loss criteria of the NPFA 1971 standard. For these reasons, responders often prefer not to wear structural firefighting protective clothing when performing more routine emergency activities, such as technical rescue operations or when responding to motor vehicle accidents.

Technical rescue clothing, such as is associated with rescue and recovery aspects of NFPA 1951, is typically less bulky, allowing for greater mobility and/or breathability while also affording a responder adequate protection for most tasks that he or she may encounter. Typically, technical rescue garments include an abrasion resistant outer shell and a moisture barrier, but lack a separate thermal barrier. Lower thermal protection criteria (e.g., 10 Watts per square meter indicated by NPFA 1951) and minimum water penetration resistance (e.g., none indicated by NFPA 1951), among other criteria, enable Total Heat Loss criteria for technical rescue garments to be higher than equivalent criteria for structural firefighting garments. By way of example, NFPA 1951 indicates a minimum Total Heat Loss value of 450 Watt per square meter for garments used in rescue and recovery activities, which provides greater breathability than the minimum Total Heat Loss value of 205 Watts per square meter indicated by NFPA 1971 for structural firefighting activities.

Although various embodiments are described herein with respect to use by first responders, such as firefighters, it is to be appreciated that aspects of the invention are not limited in this respect. Various embodiments of the garments described herein may be suitable for use by persons engaged in other activities, particularly where exposure or potential exposure to fire, flame, or excessive heat is involved. Some non-limiting examples of such activities include kiln operation or maintenance, and military operations where military personnel may be exposed to fire and/or flame.

Turn now to the Figures and initially FIGS. 1A and 1B that show, respectively, a front view and a rear view of one embodiment of a jacket 100 that may be used in rescue and recovery activities. The jacket includes a torso portion 102 and a left sleeve 104 and a right sleeve 106 that each extend from corresponding portions of the torso portion. Pleats or gussets 116 are positioned underneath the junction between each sleeve and the torso portion to provide increased freedom of movement. Each sleeve terminates in a wrist cuff 112. One or more closure mechanisms 122 extend operatively to join left and right sides of the torso portion of the jacket. A collar 108 extends upward from a neck or the torso portion 102 to provide protection for the neck of a wearer. The jacket 100 includes a back portion 120 that extends downward from a rear of the torso portion 102, as shown in FIG. 1B.

Figures 2A, 2B:
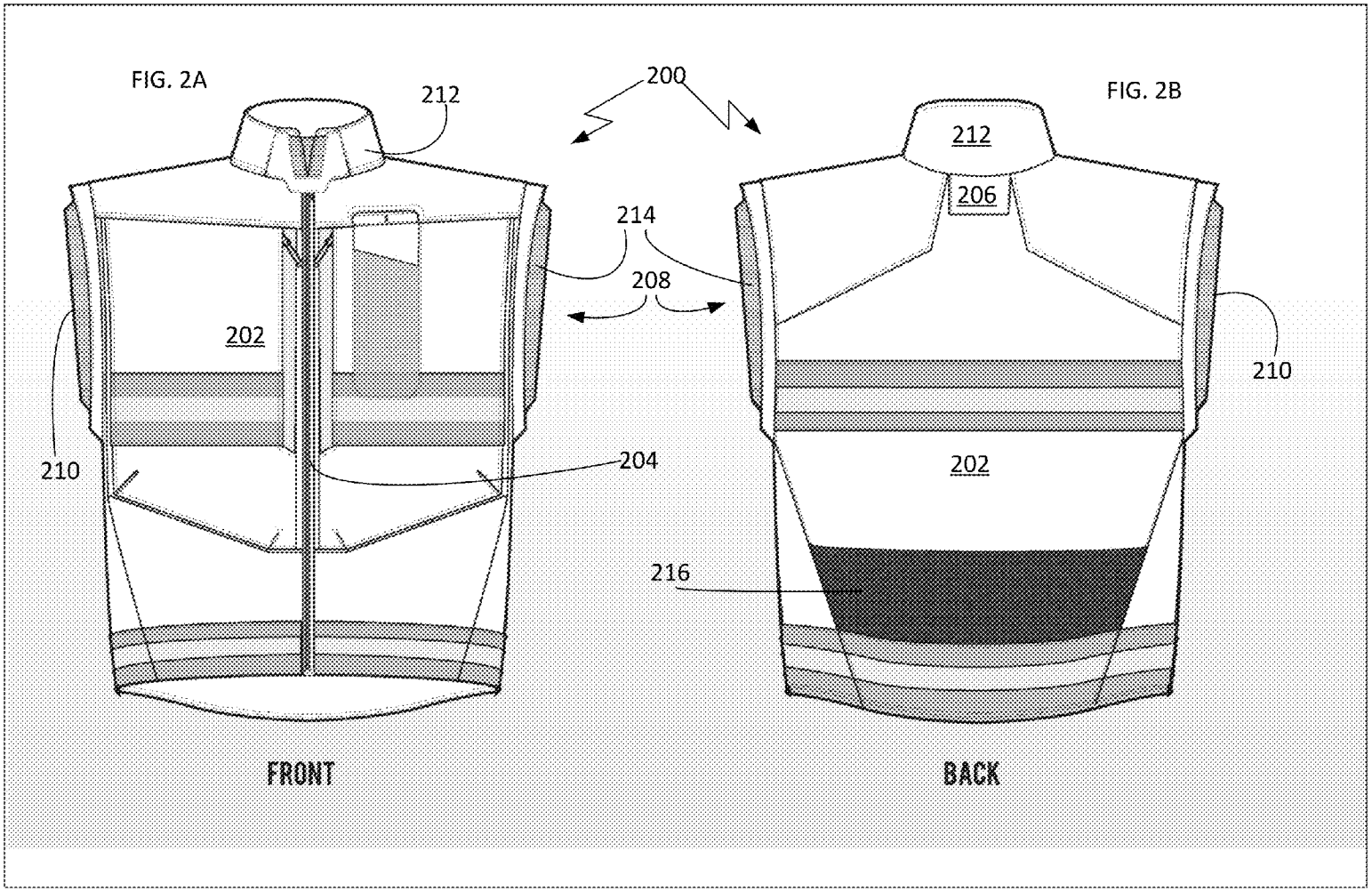
FIGS. 2A and 2B provide front and rear views of one embodiment of a vest.
Figure 3:
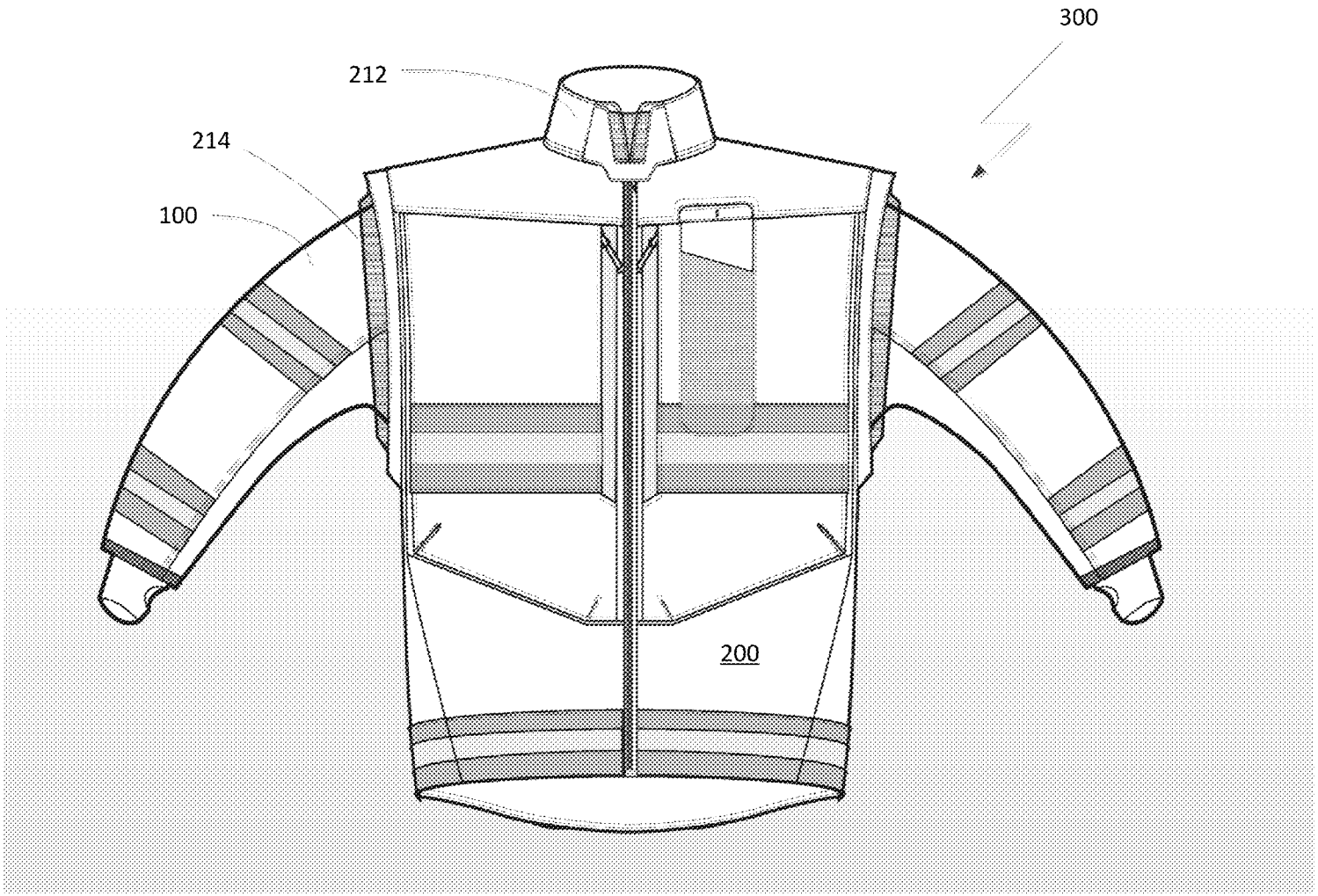
FIG. 3 is a front view of a combined jacket including the jacket and vest of FIGS. 1 and 2, respectively.

A vest that may be worn in combination with the sleeved jacket of FIGS. 1A and 1B, according to one embodiment, is shown in FIGS. 2A and 2B. The vest 200 includes a vest torso portion 202, a left arm hole 208, a right arm hole 210. Other embodiments of the vest 200 include short sleeves or sleevelets (not shown) that may extend as far as to the elbow of each arm of a wearer. Each of the left and right arm holes includes an arm cuff 214. One or more closure mechanisms 204 operatively join left and right sides of the torso portion of the jacket. A vest collar 212 extends upward from a neck area of the vest 200. FIG. 3 shows the vest 200 positioned over the sleeved jacket 100 of FIGS. 1A and 1B as a combined jacket 300, or equivalently, a jacket ensemble.

Each of the sleeved jacket 100 and vest 200 may include an outer shell that provides some thermal protection, fire resistance, abrasion and/or wear resistance, among other aspects. As shown in FIGS. 1A and 1B, the outer shell typically covers a majority of the exterior surface of the jacket. Similarly, an outer shell covers the exterior surfaces of the vest according to many embodiments. A liner 22 that includes a moisture barrier 18 and/or a thermal barrier 20 may lie inside of the outer shell 110 in either the sleeved jacket 100 or the vest 100, as shown in the embodiment of FIG. 4 discussed in greater detail below.

According to many embodiments, shell material for both the jacket and the vest is selected to be suitable for use in both rescue and recovery and in structural firefighting activities, satisfying each associated standard. This may include various criteria indicated by NFPA 1971, such as tear resistant up to values of 22 pounds force and tensile strengths of 140 pounds force or higher. This may additionally include some criteria indicated for rescue and recovery activities that are more stringent than for structural firefighting activities, such as minimum abrasion resistance of 50 pounds force and minimum water absorption of 15% or less specified by NFPA 1951, as compared to no minimum abrasion resistance specified and a minimum water absorption of 30% or less specified by NFPA 1971. Examples of materials from which an outer shell may be constructed include, but are not limited to, meta and para-aramids (NOMEX and KEVLAR), polybenzimidaxazole (PBI), polybenzobisoxazole (PBO), melamine (BASOFIL), and blends thereof. Some examples of material trade names include PBI MAX (TRADEMARK) and MILLNEIA XTL (TRADEMARK).

Portions of the outer shell 110 of the sleeved jacket 100 that are covered by the vest 200 when the combined jacket 300 is configured for structural firefighting may be constructed to be suitable for rescue and recovery, rather than structural firefighting, according to some embodiments. As is to be appreciated, the outer shell surface of the combined jacket 300 effectively includes the outer shell of the vest and portions of the sleeves 104, 106 of the sleeved jacket 100 that are not effectively covered by the vest 200. This may enable portions of the sleeved jacket that are covered by the vest, such as portions of the jacket torso 102, to be constructed for rescue and recovery activities rather than structural firefighting activities. Among other differences, these portions of the sleeved jacket 100 may exhibit a lower tensile strength, such as a minimum value of 90 pounds force indicated by NFPA 1951 for garments used in rescue and recovery.

A moisture barrier that prevents or inhibits the ingress of liquids and/or vapors may be incorporated into the sleeved jacket 100. In this respect the sleeved jacket may include a moisture barrier as indicated for rescue and recovery activities. Additionally, the combined jacket 300 may rely on the same moisture barrier of the sleeved jacket to provide suitability for structural firefighting, at least insofar as the inclusion of a moisture barrier is indicated. In such embodiments, vest 200 may be constructed without a moisture barrier.

To promote breathability of the sleeved jacket 100 when worn without the vest 200 for rescue and recovery, the moisture barrier in portions of the sleeved jacket 100 that are operatively covered by the vest may be constructed to be suitable for rescue and recovery rather than structural firefighting. Higher water penetration resistance (e.g., 25 pounds per square inch indicated by NFPA 1971), among other criteria, may be associated with structural firefighting. Moisture barriers that satisfy such structural firefighting criteria may be less breathable. Thus, according to some embodiments, improved breathability for technical rescue may be obtained by constructing the jacket 100 and vest 200 such that some or all of a moisture barrier or features that enable suitability for structural firefighting, insofar as a moisture resistance is concerned, are included in the vest rather than the torso portion of the sleeved jacket.

Moisture barriers used in either the sleeved jacket 100 and/or vest 200 may be formed of various materials. By way of example, moisture barriers may include woven and/or non-woven materials such as membrane films. The moisture barrier 18 may include one or more layers, for example, the moisture barrier 18 may be a laminate comprising a backing material or support layer laminated to a layer of semi-permeable membrane material and may also include an abrasion resistant material. Different layers may be affixed together by, for example, an adhesive or lamination. Some examples of polymers that may be useful as adhesives include polyurethane, natural latex rubber, nitrile rubber, silicone rubber, butyl rubber, fluorinated rubber, elastomeric copolymers, copolyether polyester, polyester, ethylene vinyl acetate or polyamide.

According to some embodiments, moisture barriers may include selectively permeable materials such as semi-permeable or "breathable" membranes that are water vapor permeable, and may be flame resistant. Selectively permeable materials can include, for example, polyurethane, polytetrafluoroethylene (PTFE), polyester, polyether, polyamide, polyacrylate, copolyether ester and copolyether amides. Some preferred breathable membranes include expanded PTFE such as described in U.S. Pat. No. 4,187,390 which is hereby incorporated by reference herein. Other non-limiting examples of materials that may be used in one or more layers of a moisture barrier 18 include aramids such as NOMEX and para-aramids such as poly para-phenylene-terephthalamide. Some additional trade names of moisture barriers that may be used include STEDAIR GOLD (TRADEMARK) and CROSSTECH BLACK (TRADEMARK).

The sleeved jacket 100 and/or vest 200 may include one or more thermal barriers to provide thermal protection beyond that associated with a shell and/or moisture barrier. Generally speaking, structural firefighting garments include thermal barriers while rescue and recovery garments do not. Thermal barriers may be incorporated into a jacket 100 and vest 200 in a manner that allows the jacket 100 to be suitable for use in rescue and recovery when worn without the vest 200 and that allows the combined jacket and vest, when worn together, to be suitable for use in structural firefighting. As a reference, NFPA 1951 identifies a Thermal Protective Performance (TPP) score of 10 for rescue and recovery garments while NPFA 1971 indicates a TPP score of 35 for structural firefighting garments.

Portions of the sleeved jacket 100 that do not overlap with the vest when worn together may include thermal barriers to provide suitability for structural firefighting when the jacket is worn with the vest 200. These portions may include sleeves 104, 106 of the jacket 100. Other portions of the sleeved jacket 100 may lack thermal barriers or include thermal barriers that provide less thermal protection. In this regard, breathability may be improved, such as for rescue and recovery activities. As is to be appreciated, standards for rescue and recovery activities indicate higher breathability (NFPA 1951 indicates a minimum THL of 450 Watts per square meter) than standards for structural firefighting (NFPA 1971 indicates a minimum THL of 205 Watts per square meter for structural firefighting activites).

When used, thermal barriers are often incorporated into a liner of a garment. By way of example, FIG. 4 shows a liner 22 that includes a thermal barrier 20 and a moisture barrier 18. The liner is attached to the outer shell 110 of a sleeved jacket by threads, although other attachments are also possible and are contemplated. An alternate arrangement is shown in the embodiment of FIG. 5 where a moisture barrier 18 is split into multiple layers, some of which are be disposed on opposing sides of a thermal barrier 20. In FIG. 5, the thermal barrier 20 includes a first thermal barrier layer 20' and second thermal barrier layer 20". Similarly, the moisture barrier 18 is divided into a first barrier layer 18' and a second barrier layer 18". As shown in the embodiment pictured in FIG. 5, the first moisture barrier 18' and second moisture barrier 18" are separated by the first thermal barrier layer 20' and second thermal barrier layer 20". In FIG. 5, the layers are shown to be secured by binding 15 and threads 17 and 19, although other attachments are also possible, including adhesions and mechanical fasteners, such as snaps, and hook and loop type fasteners to name a few.

According to one embodiment, thermal barriers are positioned within sleeves 104, 106 of jacket 100 as part of a liner 22. The liner may extend throughout the torso portion 102, including a moisture barrier 18, but without a thermal barrier 20 or with a thermal barrier offering less protection than in the sleeves. A vest, according to the same embodiment, may be constructed of an outer shell and a liner that includes a thermal barrier, but that lacks a moisture barrier. Such a vest may cover areas of the sleeved jacket that lack a thermal barrier and/or that lack thermal protection suitable for structural firefighting activities. In this manner, the combined jacket 300 may be suitable for structural firefighting, while either of the sleeved jacket or the vest would not be suitable for structural firefighting when worn individually.

A liner or a portion of a liner may be removable from the outer shell of a jacket or vest. According to one embodiment, thermal barriers that are positioned within the sleeves of a jacket 100 may be removable. In this respect, sleeves 104,106 of a jacket may be configured to provide greater breathability (i.e., higher minimum Total Heat Loss), which may be preferable by some responders under certain circumstances, such as during rescue and recovery activities or activities where excessive heat and fire are less of a risk. According to some embodiments, thermal barriers of the sleeves may be attached to the liner and/or the shell by fasteners, such as snaps, zippers, hook and look fasteners, buttons, and the like, that may enable removal and reinstallation. It is to be appreciated that not all embodiments may include removable thermal barriers in sleeves of the jacket, and that, according to some embodiments, such thermal barriers are installed permanently.

Thermal barriers may be constructed in a variety of ways and from a variety of materials. By way of example, thermal barrier 20 may be constructed from a NOMEX(TRADEMARK) face cloth quilted to two layers of a 70% NOMEX-30% KEVLAR (TRADEMARK) composite. The thermal barrier 20 may alternatively comprise a NOMEX face cloth quilted to a 100% NOMEX batting. The thermal barrier 20 may include a thermally reflective surface. A thermally reflective surface may be any appropriate thermally reflective material, such as a metalized material. For example, the thermally reflective material may be a substrate supporting an aluminized film. The substrate may be a flexible material and in one embodiment the substrate is a combination of polybenzimidazole (PBI) and poly-paraphenylene terephthalamide, for example, (KEVLAR TRADEMARK). In a further embodiment, the substrate may be about 33 percent PBI and about 67 percent meta-aramid and weigh up to 2, 3, 4, 5, 6, 7, 8, or more ounces per square yard, including all weights in between the integers listed. A substrate in a thermally reflective material of the invention can be a knit, woven, or non-woven substrate. The thermally reflective material can be applied to the substrate using any suitable means, including, but not limited to: coating, lamination, impregnation, casting, or depositing on the substrate. The thermally reflective material may weigh, for example, between 0.25 ounces and 2 ounces per square yard, including all weights between 0.25 and 2. In some embodiments, the sleeves may include a thermally reflective layer that may be absent in the torso. Some trade names of thermal barriers that may be used include GLIDE GOLD (TRADEMARK) and QUANTUM3D SL2I (TRADEMARK).

Sleeves 104 and 106 may be formed in any known pattern, including set-in, kimono, two-piece, or raglan. In one embodiment, sleeves 104 and 106 are formed in a modified raglan pattern, with each seam extending from collar 108 to wrist cuff 112 as shown in FIG. 1. In such a sleeve configuration, a thermal barrier layer may extend from each wrist cuff 112 to collar 108. There may be additional thermal insulation added at the intersection of sleeve 104 with collar 108 and sleeve 106 with collar 108. Pleats 116 under the arm may allow for extra rotational movement of the arm without reducing the protective characteristics of the sleeve. For example, pleated thermal barrier layer material may be included so that adequate thermal barrier protection is provided when the arm is extended upwards. As shown in FIGS. 1A and 1B, lower back portion 120 may extend lower than does the front of the jacket. This extension can provide for extra protection when the wearer bends forward which typically forces the jacket to slide upwards.

Sleeves of the jacket 100 may include wristers 112 that provide protection at an interface with gloves that may be worn by a responder. Wristers 112 may be of conventional construction and may be constructed from an elasticized fabric, stretch woven fabric, or knit fabric such as knit NOMEX aramid material, as may be suitable for structural firefighting.

The vest may include arm cuffs 214. Such arm cuffs 214 may be analogous to wristers in a jacket and may help provide suitability for structural firefighting. Arm cuffs 214 may be constructed from an elastic fabric, such as elasticized NOMEX. Such an elastic material can prevent hot air and liquids from infiltrating at the intersection of the jacket and vest and in this respect may provide a thermal seal. As discussed in greater detail herein, some embodiments of the vest may include sleeves that extend to as low as the elbows of a wearer. In such embodiments, the sleeves of the vest may be elasticized along most if not all of the length of the sleeves to promote thermal sealing therebetween.

The collar of the jacket 108 and the collar of the vest 212 may be constructed to be suitable for at least technical rescue and structure firefighting, respectively. According to one embodiment, the jacket collar 108 has a height of about 2 inches or more, providing suitability for rescue and recovery activities. The collar 108 may optionally be lined with comfortable, non-abrasive fabric, such as synthetic fleece. The collar 212 of the vest may have an increased height, as compared to the jacket collar 108. According to some embodiments, the vest collar 212 has a height of 3 inches or more, as indicated by NPFA 1971 for structural firefighting activities. In this respect, the vest collar 212 may provide suitability for the combined jacket 300 when the vest 200 is worn over the jacket 100. According to other embodiments, however, the vest may lack a collar altogether while the sleeved jacket includes a collar suitable for structural firefighting and rescue and recovery activities, such as by having a height greater than 3 inches. Either the jacket collar 108 or the vest collar 212 may include a closure that is separate or integral with a closure of the corresponding jacket or vest.

The front portions of each of the jacket 100 and the vest 200 may be outfitted with a closure 122, 204. Such closures may include, for example, hook and loop type fasteners, snaps, zippers, hook and dees, and the like. Closures 122, 204 may include multiple stages, for example, a zipper can be used that is covered with flaps that can be snapped in place to shield the zipper. Closure mechanisms 122, 204 can extend from top to bottom of the jacket or vest, or may include multiple sections that each extend between different portions of the vest. The closure can be gas and fluid tight to prevent the intrusion of gases or liquids, according to some embodiments.

A drag rescue device may be incorporated into either the jacket 100 or vest 200 so as to be accessible when the combined jacket 300 is worn for structural firefighting. By way of example, the embodiment of FIG. 2 shows a flap 206 that provide access to a stored drag rescue device. As with other features of the jacket and vest, the flap 206 may be secured with a closure such as a snap, hook and loop, or a zipper.

Structural firefighting typically entails the use of a self-contained breathing apparatus (SBCA) worn on the back of a firefighter. Embodiments of the combined jacket 300 and particularly the vest 200 may include features to accommodate an SCBA. By way of example, vest 200 may include epaulets (not shown) on the shoulder portion of the vest that receive and secure straps of an SCBA in place. A lower rear torso portion of the vest 200 may include friction pad 216, as shown in FIG. 2B, that prevents sliding of the SCBA across the back when the wearer is moving. According to some embodiments, friction pad 216 includes an abrasion-resistant material such DRAGONHIDE (TRADEMARK) reinforcement material available from Globe Manufacturing. Vest 200 may also include extra insulation above the shoulders to provide, for example, sufficient Thermal Protective Performance when insulation is compressed from wearing SCBA gear.

Various other features and/or accessories may be included with a vest or jacket. By way of example, reflectors, such as SCOTCHLITE (TRADEMARK) (3M) reflective tape or reflective material, may be positioned on the outer shell of a jacket or vest, such as on the front or rear torso portions and/or on the sleeves to improve visibility in dark or smoke filled conditions. In some embodiments, the jacket may optionally include a hood, equipment pockets or remote microphone attachment 118. Color-coding according to the structure of the jacket parts may also be used on the outer shell 110 of the jacket and/or vest to indicate to a viewer or the wearer the specific NFPA ratings of different portions of the jacket. The vest and/or jacket may include pockets, flaps or through-holes allowing access to equipment, such as radios, that may be secured to the jacket or vest.

Thermally resistant jacket 100 and thermally resistant vest 200 described in detail above may be used in conjunction to provide combined jacket 300 of an overall ensemble capable of protecting the wearer under harsh conditions. For example, a user may wear a jacket, vest and other attire such as trousers, boots, gloves and helmet for structural firefighting, as may be associated with NFPA 1971. Such an ensemble, absent the vest and potentially other portions, may be suitable for a firefighter or other first responder for other activities, such as rescue and recovery associated with NFPA 1951.

To transition the sleeved jacket between suitability for rescue and recovery and structural firefighting activities, a responder may, for example, don vest 200 after donning the jacket 100. Similarly, the vest can be removed prior to removing the jacket. According to some embodiments, an SCBA may be attached to the vest such that the act of donning the vest also positions the SCBA in a position for use. The vest may also be stored with an SCBA attached thereto, such as at a place on a fire fighting vehicle that is normally reserved for an SCBA, further enabling ease of access and use.

Figure 6:
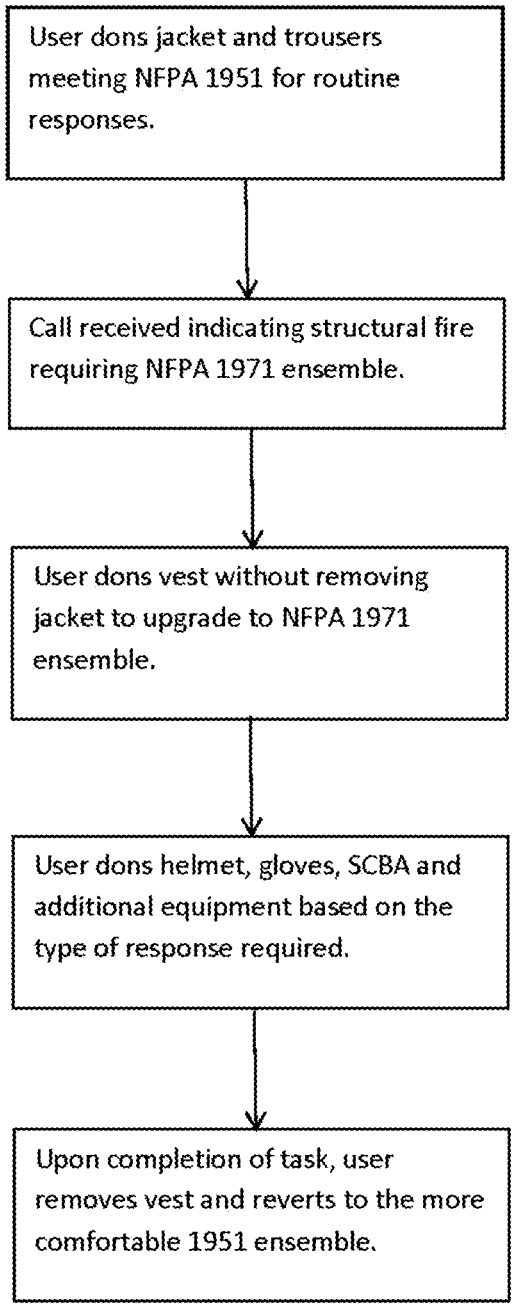
FIG. 6 is a flow chart illustrating one embodiment of a process for using some of the turnout gear described herein.

FIG. 6 provides a flow chart illustrating an example of how the jacket and vest might be used by a first responder, according to one embodiment. The user may routinely wear the sleeved jacket without the vest and, as such, may be prepared for rescue and recovery type activities, as may be associated with NFPA 1951. When a responder receives a call to an event requiring turnout gear, such as a structural fire, he or she may don the vest over the jacket that is already being worn. The vest can be stored on a response vehicle, on a rack, or any other convenient place where little or no time is used in retrieving the garment. The vest can be donned while the responder is in a vehicle. The responder can also don additional gear such as an SCBA, gloves and helmet.

Vest 200 may be secured in position over jacket 100 by various features. Mechanical fasteners, such as snaps, buttons, zippers, and the like, may secure the vest and jacket together according to some embodiments. Additionally or alternately, arm cuffs 214 of the vest may fit snugly around the armpit and shoulder portion of the jacket, stabilizing the vest 200 against the jacket 100. Such arm cuffs may include elastic to secure a tight fit around the jacket sleeve to minimize or eliminate the formation of any gaps at the junction of cuff 214 and jacket sleeve 104, even when the arm is rotated through a full range of motion.

According to some embodiments, a connector may be positioned to secure the arm cuffs of the vest to the sleeves of the jacket. For example, the inner surface of the vest or an arm cuff may include one half of a hook and loop fastener while the outer sleeve of the jacket includes the complementary half of the hook and loop fastener. A fastener strip (either hook or loop) can circumscribe the outer surface of the jacket sleeve while the complementary strip circumscribes an inner surface of the vest arm cuff or vest arm opening. In one embodiment the loop portion of the hook and loop fastener is on the jacket as the loop portion is less likely to retain dirt and debris on the more regularly exposed surface of the jacket.

According to some embodiments, the vest can be placed over the jacket without additional fasteners to secure the two together, allowing for a quick transition between wearing the jacket without the vest, such as for rescue and recovery activities, and with the vest for structural firefighting. The freedom of movement of jacket 100 and vest 200 in relation to each other, according to such embodiments, may also provide for a greater range of motion as the two garments can move independently of each other.

It is to be appreciated that although shown without sleeves and described as a "vest", that the vest 200 may also include sleeves or sleevelets that extend about a portion of a wearers arm down to as far as the elbows of the wearer. In contrast, the sleeved jacket or jacket described herein includes long sleeves that extend to the wrist of a wearer. Although described as a "vest", it is to be appreciated that the vest may have the appearance of a short-sleeved jacket rather than a conventional sleeveless vest, according to some embodiments. Such sleeves or sleevelets may help provide a "thermal overlap" between the vest and jacket that may reduce or eliminate a possibility of thermal gaps forming between the two garments when arms and body are moved vigorously in various directions during a response. The thermal barriers of the sleeve of the jacket and the vest may overlap by a minimum distance, according to some embodiments, to prevent thermal gaps. Such thermal overlap may be up to one inch or greater, up to two inches or greater, or up to three inches or greater, according to some embodiments. Any sleeves of the vest or portions thereof may be elasticized or may include mechanisms that compress the vest sleeves about those of the sleeved jacket, promoting a thermal seal therebetween Thermal Testing Thermal Protective Performance (TPP) testing measures the amount of time for convective and radiant heat to penetrate through the layers of the composite garment. Typically, the layers through which heat is measured are the outer layer, thermal barrier layer, and moisture barrier layer. The fabric(s) of the garment are placed beneath a sensor, or calorimeter, which records the temperature transmitted through the layers of the garment. The garment is exposed to flame and radiant heat, in simulation of a flashover situation. The sensor records the average temperature rise and the results are graphically mapped. This curve is then compared to the Stoll's curve, which shows the blister point of human skin as a function of heat and time. Where the curves intersect is reported as the garment's TPP score or rating. The TPP score is reported as time-to-burn multiplied by the exposure energy (2 calories per square centimeter per second). Generally speaking, the TPP rating is approximately double the number of seconds the garment will protect human skin against high heat before a second-degree burn will ensue. Thus, a TPP rating of 35 equates to 17.5 seconds until a second degree burn will occur in a flashover situation.

Total Heat Loss (THL) measures how well garments allow body heat to escape through the layers of a garment. THL is reported in watts per meter squared ($W/m^2$), and typically correlates inversely with TPP. To measure THL, heat flow through the layers of the garment is measured under both dry and wet conditions using a hot plate that simulates human skin temperature. Higher THL values tend to indicate that a material is more "breathable" and therefore more comfortable. Additional testing procedures and requirements are available in NFPA 1951 and NFPA 1971.

The standards referenced herein, including EN 469 and the 2013 versions of NFPA 1951 and NFPA 1971, are hereby incorporated by reference in their entirety. It is to be appreciated, however, that these standards and any comments made in these standards are only applicable to aspects of embodiments of the present invention that are explicitly stated to satisfy a corresponding standard or an aspect of a standard. Any statements herein that an embodiment or feature of an embodiment may be suitable for a particular activity, such as rescue and recovery or structural firefighting, shall not be taken as a statement that such features or embodiments satisfy standards associated with such activities.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention. All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A firefighting garment comprising:

a jacket comprising:

a torso portion exhibiting a Thermal Protective Performance score of less than 35;

two sleeves attached to the torso portion, each sleeve exhibiting a Thermal Protective Performance score of at least 35; and a vest that is wearable over the jacket, the vest including a torso portion that, in combination with the torso portion of the jacket, provides a Thermal Protective Performance score of at least 35.

2. The firefighting garment of claim 1, wherein each of the two sleeves of the jacket includes an abrasion resistant layer, a moisture barrier layer and a thermal barrier layer.

3. The firefighting garment of claim 2, wherein at least a portion of the thermal barrier layer is removable from each of the two sleeves of the jacket.

4. The firefighting garment of claim 2 wherein the torso portion of the jacket, absent the vest, exhibits a Total Heat Loss (THL) of greater than 450 $W/m^2$.

5. The firefighting garment of claim 2, wherein the torso portion of the jacket in combination with the torso portion of the vest exhibits a Total Heat Loss (THL) of greater than 205 W/m2.

6. The firefighting garment of claim 1, wherein the vest includes a collar having a height of at least 3 inches.

7. The firefighting garment of claim 1, wherein the jacket includes a collar having a height of less than 3 inches.

8. The firefighting garment of claim 1, wherein the vest includes cuffs that form a thermal seal with the sleeves of the jacket.

9. The firefighting garment of claim 1, wherein the vest further comprises a drag rescue device.

10. The firefighting garment of claim 1, wherein the jacket and vest when worn together meet the NFPA 1971 standard for a structural firefighting garment and the jacket worn in the absence of the vest and removable thermal barriers of the two sleeves meets the NFPA 1951 standard for a rescue garment.

11. A protective vest, comprising:

a torso portion that defines a first arm opening and a second arm opening; a first sleeve cuff and a second sleeve cuff, the first sleeve cuff positioned at the first arm opening of the torso portion on the protective vest and the second sleeve cuff positioned at the second arm opening of the torso portion of the protective vest;

an outer shell that provides an outer surface of the torso portion;

a thermal barrier extending about the torso portion and lying interior to an outer surface of the outer shell; and a drag rescue device incorporated into the vest, wherein , both of the first sleeve cuff and the second sleeve cuff are constructed and arranged to engage a sleeve of a jacket worn beneath the protective vest.

12. The protective vest of claim 11, further comprising:

a first short sleeve and a second short sleeve, sleeves each of which extends from a corresponding one of the first arm opening and the second arm opening of the torso portion, the outer shell and the thermal barrier extending about at least a portion of each of the pair of short sleeves.

13. The protective vest of claim 11, further comprising:

a friction pad positioned on an outward facing portion of outer shell to engage an self-contained breathing apparatus.

14. The protective vest of claim 11, further comprising:

one or more mounting features for an SCBA.

15. The protective vest of claim 14, wherein the one or more mounting features include epaulets.

16. A modular firefighting garment comprising:

a jacket that includes a torso portion and two sleeves attached to the torso portion, the torso portion and the two sleeves having a flame-resistant outer layer and a moisture barrier that lies interior to the outer layer, the two sleeves having a thermal barrier that provides a Thermal Protective Performance score of at least 35, which is greater than a Thermal Protective Performance Score of the torso portion of the jacket;

a vest that is separate from the jacket and that is constructed and arranged to be worn over the jacket, the vest including a torso portion and having a flame resistant outer layer and a thermal barrier such that, when worn over the jacket, thermal protection of the combined torso portion of the jacket and torso portion of the vest is equivalent to or greater than the thermal protection provided by the two sleeves of the jacket.

* * * * *